US010815635B2

(12) United States Patent
Marchetta et al.

(10) Patent No.: US 10,815,635 B2
(45) Date of Patent: Oct. 27, 2020

(54) TOOL HOLDER FOR A WORK VEHICLE OR CONSTRUCTION MACHINE

(71) Applicant: GROUPE MECALAC, Annecy-le-Vieux (FR)

(72) Inventors: Henri Marchetta, Sevrier (FR); Maxime Boni, Sillingy (FR); Nicolas Putod, Pringy (FR)

(73) Assignee: GROUPE MECALAC, Annecy-le-Vieux (FR)

( * ) Notice: Subject to any disclaimer, the term of this patent is extended or adjusted under 35 U.S.C. 154(b) by 293 days.

(21) Appl. No.: 15/504,237

(22) PCT Filed: Oct. 9, 2015

(86) PCT No.: PCT/FR2015/052721
§ 371 (c)(1),
(2) Date: Feb. 15, 2017

(87) PCT Pub. No.: WO2016/059328
PCT Pub. Date: Apr. 21, 2016

(65) Prior Publication Data

US 2017/0275847 A1 Sep. 28, 2017

(30) Foreign Application Priority Data

Oct. 13, 2014 (FR) ..... 14 59818

(51) Int. Cl.
*E02F 3/36* (2006.01)
*E02F 3/30* (2006.01)
*E02F 3/32* (2006.01)

(52) U.S. Cl.
CPC ..... *E02F 3/3663* (2013.01); *E02F 3/308* (2013.01); *E02F 3/32* (2013.01); *E02F 3/3609* (2013.01); *E02F 3/3618* (2013.01); *E02F 3/3636* (2013.01)

(58) Field of Classification Search
CPC ..... E02F 3/3663; E02F 3/3609; E02F 3/308; E02F 3/3618; E02F 3/32; E02F 3/3636
See application file for complete search history.

(56) References Cited

U.S. PATENT DOCUMENTS 5,549,440 A * 8/1996 Cholakon ..... E02F 3/3622 37/468
5,890,871 A * 4/1999 Woerman ..... E02F 3/3627 37/468

(Continued)

FOREIGN PATENT DOCUMENTS

AT 400867 B 4/1996
DE 4109783 A1 9/1991

(Continued)

OTHER PUBLICATIONS

International Search Report issued in PCT/FR2015/052721 dated Feb. 15, 2016.
Written Opinion issued in PCT/FR2015/052721 dated Feb. 15, 2016.

*Primary Examiner* — Michael S Lowe
(74) *Attorney, Agent, or Firm* — Marshall, Gerstein & Borun LLP

(57) ABSTRACT

A tool holder includes a locking cylinder provided with two first gripping pins extending laterally from each side of the fixed part thereof, and two second gripping pins extending laterally from each side of the moving part thereof. The tool includes at least two reception assemblies each having a first receiving portion and a second receiving portion the openings of which are each facing and provided to receive one of the first gripping pins and one of the second gripping pins for retaining the tool on the tool holder. The tool is locked on the tool holder by means of the locking cylinder by moving each gripping pin into abutment at the bottom of the associated receiving portion thereof.

10 Claims, 4 Drawing Sheets

(56) References Cited

U.S. PATENT DOCUMENTS

| | | | | |
|---|---|---|---|---|
| 6,234,061 | B1 * | 5/2001 | Glasson | F15B 15/283 33/763 |
| 2003/0103804 | A1 * | 6/2003 | Bjuhr | E02F 3/3636 403/321 |
| 2006/0263189 | A1 * | 11/2006 | Vigholm | E02F 9/2004 414/685 |
| 2011/0091267 | A1 * | 4/2011 | Hill | E02F 3/3618 403/31 |
| 2011/0262212 | A1 * | 10/2011 | Luyendijk | E02F 3/3618 403/31 |
| 2014/0123635 | A1 * | 5/2014 | Van Hooft | E02F 3/3654 60/327 |
| 2014/0231564 | A1 * | 8/2014 | Van Gemert | E02F 3/3622 241/264 |

FOREIGN PATENT DOCUMENTS

| | | | |
|---|---|---|---|
| FR | 2475160 | A1 | 8/1981 |
| FR | 2708679 | A1 | 2/1995 |
| WO | WO-2007/038960 | A1 | 4/2007 |

* cited by examiner

TOOL HOLDER FOR A WORK VEHICLE OR CONSTRUCTION MACHINE

TECHNICAL FIELD

The present disclosure relates to the technical field of construction machines. It deals with a tool holder for construction machines used for example in connection with urban worksites, railway work, and service and maintenance worksites.

More precisely the disclosure relates to a tool holder for a worksite machine with which the operator of the machine can automatically take and assemble a work tool.

BACKGROUND

Worksite or construction machines of the handling, loading or lifting machine type, or of the loader-excavator earthmoving machine type or similar comprise work equipment in the form of an articulated arm at the end of which a work tool is installed.

The work tools generally comprise of either a bucket, a shovel, a loader bucket, a hydraulic tool (e.g. rock-breaker, earth auger, brush cutter, etc.) or other tools, according to the type of use. In general, the changing and assembly of these tools proves to be a long and difficult operation considering both the weight of each of them and also the conditions under which this change is performed, most often on-site, meaning at the worksite.

On average, during a working day, the operator of the worksite machine can require to change a tool several dozens of times. On each occasion these mounting and unmounting steps require the machine to be unavailable for several minutes. Altogether these periods of unavailability represent a non-negligible loss of productivity.

There is therefore a need to simplify the use of a mechanism for the attachment of a tool to a worksite machine in order to allow the operator of the machine to perform these changes more quickly.

In the French patent FR 2,475,160 A1, the Applicant described a worksite machine comprising an arm at the end of which a tool holder is attached allowing a tool to be picked up automatically. The assembly of the tool onto the tool holder is performed by means of several sets of conic frustum lugs present on the tool holder and corresponding housings born on the tool. When the operator wants to attach a tool onto the tool holder, the operator needs to simultaneously insert the pairs of lugs into the housings. To do that, the operator must position the worksite machine relative to the tool such that the lugs are rigorously aligned with the female housings. This alignment step requires some degree of dexterity on the part of the operator because the operator must first correctly position the worksite machine relative to the tool such that the lugs are aligned with the housings and then, secondly, control the articulated arm such that the lugs are inserted into the female housings.

Considering the relatively small dimensions of the housings on the tool, the operator may find it necessary to make several attempts before succeeding with this assembly. These successive attempts represent a loss of time and are stressful for the operator.

To make this assembly easier, the Applicant subsequently proposed a tool holder in French patent FR 2,708,679 A1 comprising housings at a lower part and a horizontal pin at an upper part. Advantageously, the horizontal pin facilitates the insertion of the lugs into the housings at a lower part of the tool. In order to do that, near an upper part, the tool comprises a set of tabs having openings, intended to guide the horizontal pin of the tool holder. When the horizontal pin is engaged and progresses into said openings, the tool swings until the plugs automatically engage with the female housings. With this solution the operator can more easily grasp the tool because the inclination of the tool holder relative to the tool then has little influence.

Just the same the operator still needs to perfectly position the machine relative to the tool such that the horizontal pin can be simultaneously inserted into the openings formed by the set of tabs on the tool holder. In other words, if the pin of the horizontal bar is not perfectly aligned with the pin connecting the openings, there is a risk of the operator grasping the tool crosswise by engaging the horizontal pin in only one of the openings.

Hence, properly positioning the machine relative to the tool can turn out to be delicate because of the uneven surface of the worksite. The operator can thus lose time properly positioning the machine relative to the tool on the worksite. This positioning problem becomes even more critical when the worksite machine moves on rails. A mispositioning of the tool along the track can then prevent the operator from grasping it.

The German patent DE 41 09 783 proposes an attachment mechanism between a tool and a tool holder by means of a moving cylinder providing a locking of the tool on the tool holder. For this purpose, the tool comprises a front anchoring point and a rear anchoring point intended to receive two pins of the tool holder. Each anchoring point comprises two C-shaped parts intended to surround a substantially corresponding part at 50% of the perimeter of the tool holder pin. The cylinder serves to adjust the distance between the C-shaped parts such as to secure the pins of the tool holder in the C-shaped parts in order to lock the tool onto the tool holder. However, if there is a failure of the cylinder, the C-shaped parts are not sufficient to retain the tool on the tool holder, in particular in case of large amplitude swinging movement.

SUMMARY OF THE DISCLOSURE

The purpose of the presently described embodiments is consequently to remedy the disadvantages from the prior art by proposing a new tool holder for worksite machine such that the operator of the machine can grasp a tool with greater freedom of positioning of the machine relative to the tool. Another objective is to provide a solution with which to eliminate, or at least reduce to a minimum, the risks of the tool falling during assembly operations.

The objectives attributed to the disclosed embodiments are achieved using an assembly formed by a tool and a tool holder intended to allow the quick and reversible assembly of a tool on the free end of the working arm of the worksite or construction machine, where the working arm comprises a stick that ends in a fork and is equipped with a link and cylinder assembly intended to manipulate the tool when it is mounted on the free end thereof, characterized in that:

The tool holder comprises a locking cylinder comprising a fixed part mounted in rotation on the free end of the stick and a moving part connected to the fixed part by a rod and mounted pivoting on the end of the link and cylinder assembly;

The tool holder comprises two first gripping pins extending laterally from each side of the fixed part and two second gripping pins extending laterally from each side of the moving part of the locking cylinder;

The tool comprises at least two receiving assemblies suited to engage with the gripping pins of the tool holder;

Each receiving assembly comprises two gripping fingers forming a first receiving part and a second receiving part for which the openings are facing and each intended to receive one of the first gripping pins and one of the second gripping pins in order to keep the tool on the tool holder;

The tool is suited to be locked and unlocked on the tool holder by means of the locking cylinder by reversibly changing the distance between the moving part and the fixed part thereof, between an extended position of the locking cylinder in which each of the first gripping pins is moved into abutment at the bottom of the associated receiving portion thereof and each of the second gripping pins is moved into abutment at the bottom of the associated receiving portion thereof, and a retracted position of the locking cylinder in which the gripping pins can be extracted from the receiving assemblies;

The shape of the gripping fingers is adapted such that the tool does not disengage from the first gripping pins in the event of a large amplitude swinging movement.

Thus, the picking up of the tool by the worksite machine is quick and easy and the operator of the machine has complete visibility of the parts that the operator must mutually engage. The centering of the tool on the tool holder occurs automatically by the tool swinging on the gripping pins during the lifting thereof.

According to an embodiment, the receiving parts are shaped like hooks or semicircular notches whose inner diameter is slightly greater than the outer diameter of the gripping pins that it is suited to receive. These hooks allow a grasp of the tool that is simultaneously secure, quick and easy. They also allow the tool to be mounted in one direction or the other, which can be particularly useful for buckets which can be used as a loader or as an excavator, meaning upside down if necessary, because the tool holder is reversible.

According to another exemplary embodiment, the first receiving parts each have a gripping finger partially covering the opening thereof, whereas the second receiving parts do not have one. In that way, because of the gripping fingers, the tool cannot fall from the tool holder even in case of unintended unlocking.

According to an additional exemplary embodiment, the fixed part of the locking cylinder comprises a mounting pin on each of the lateral sides thereof which is held on the fork by a chamfered retaining ring.

According to an additional exemplary embodiment, the moving part of the locking cylinder comprises a mounting pin on each of its lateral sides which is held near the end of the link and cylinder assembly by a chamfered retaining ring.

The tool holder can in that way take the tool with a small angle, because of the gripping chamfers.

According to an exemplary embodiment, the locking cylinder is a hydraulic cylinder.

According to an additional exemplary embodiment, the locking cylinder is equipped with an anti-return valve which secures the fluid in the large chamber when the locking cylinder is subject to external forces. This anti-return valve can be placed in the rod closest to the chamber to be protected. It serves to avoid an accidental unwanted approach of the gripping pins in order to avoid unintended unlocking of the tool.

According to another exemplary embodiment, the locking cylinder has an intended over-range such that the locking extended position of the locking cylinder does not correspond to the end of range thereof. Thus, the tool holder is provided with a play adjustment to overcome wear.

Similarly, the various tool holder pins undergo a surface treatment intended to increase their wear resistance and they are removable so as to be able to be replaced easily without having to completely disassemble the tool holder or completely replace it.

According to an additional exemplary embodiment, the locking cylinder is equipped with a means of detection of the position of the rod so as to provide good locking of the tool by the tool holder.

Finally among the many other advantages, the tool may comprise receiving means on several surfaces thereof in order to be grasped by the tool holder according to several locations and positions.

This architecture also allows a weight increase compared to other known solutions.

BRIEF DESCRIPTION OF THE DRAWINGS

Other features and advantages of the described embodiments will become clearer in reading the description that follows, made in reference to the attached figures, given by way of non-limiting examples, in which.

DETAILED DESCRIPTION

Structurally and functionally identical elements that appear in multiple figures are given a single numeric or alphanumeric reference.

Figure 1:
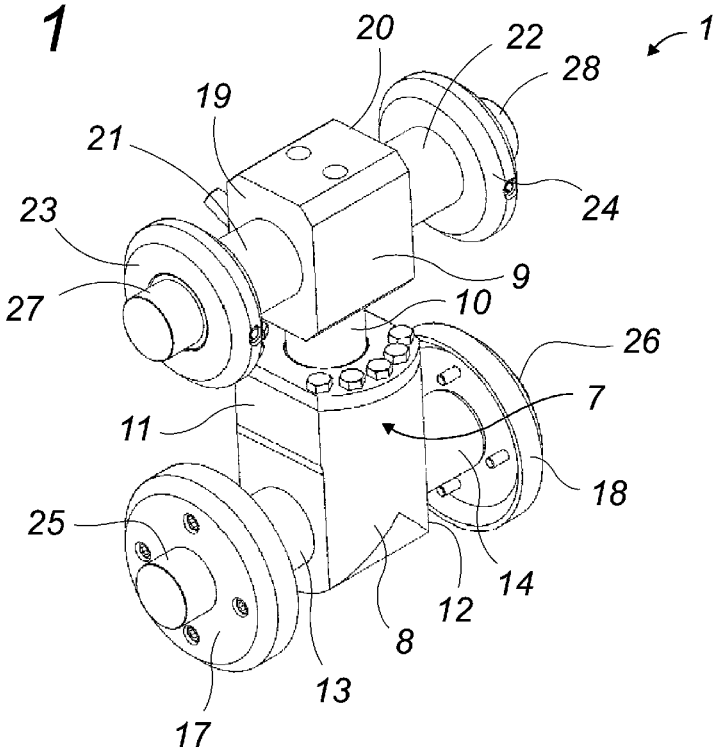
FIG. 1 is a perspective view of the tool holder according to the present disclosure.
Figure 2:
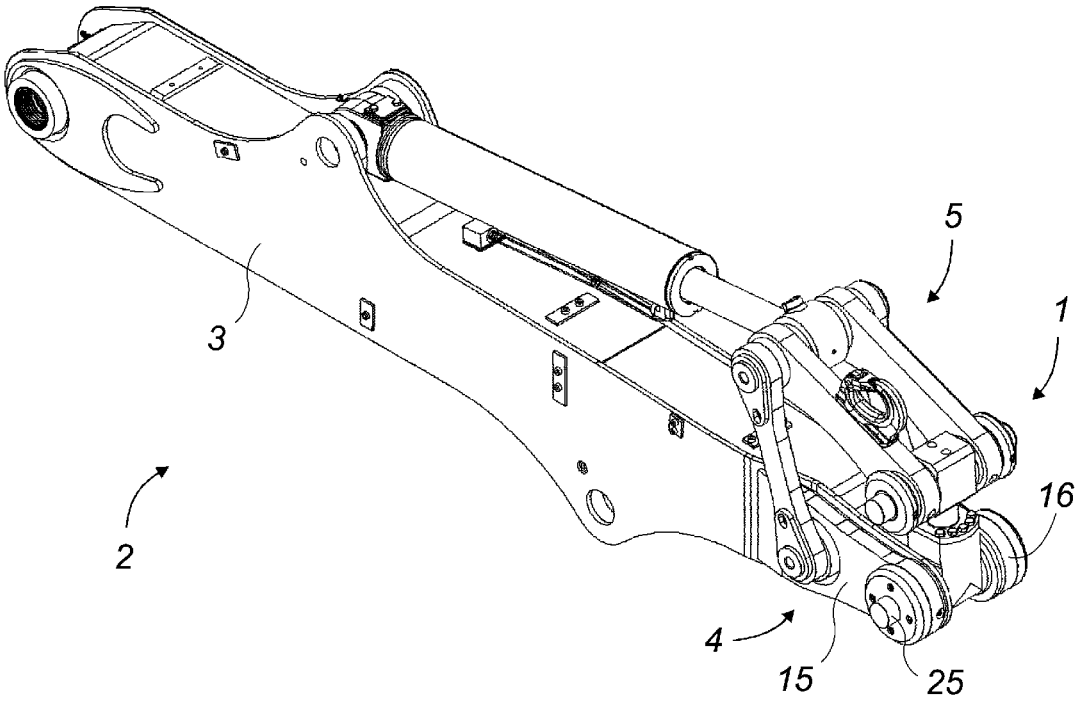
FIG. 2 is a perspective view of the working arm of a worksite machine equipped with a tool holder.

The tool holder (1) such as shown in isolation in FIG. 1 is intended to equip the free end of the working arm (2) of the worksite machine, for example the backhoe type, as shown in FIG. 2. The working arm (2) includes a stick (3) ending in a fork (4) and is equipped with a link and cylinder assembly (5) intended to manipulate the tool (6) mounted on its free end. This link and cylinder assembly (5) is known to the person skilled in the art and will not be detailed here.

The tool holder (1) comprises a locking cylinder (7) comprising a fixed part mounted (8) at the free end of the stick (3) and a moving part (9) connected to the fixed part (8) by a rod (10) and mounted at the end of the link and cylinder assembly (5).

The locking cylinder (7) is a hydraulic cylinder.

On each of the lateral surfaces (11, 12) thereof, the fixed part (8) of the locking cylinder (7) has a mounting pin (13, 14) mounted swinging between the side plates (15, 16) of the fork (4). The mounting pins (13, 14) are mounted on the side plates (15, 16) and held laterally by retaining rings (17, 18).

Similarly, on each of the lateral surfaces (19, 20) thereof, the mobile part (9) of the locking cylinder (7) has a mounting pin (21, 22) mounted swinging at the end of the link and cylinder assembly (5), where this mounting is locked laterally by retaining rings (23, 24).

The tool holder (1) is in that way mounted swinging at the free end of the stick (3) so as to be able to pivot in a vertical plane from the movements of the link and cylinder assembly (5).

Each of these mounting pins (13, 14, 21, 22) is extended beyond the retaining rings (17, 18, 23, 24) by a gripping pin (25, 26, 27, 28).

Two first gripping pins (25, 26) extending laterally near the fixed part (8) of the locking cylinder (7) are in that way distinguished from two second gripping pins (27, 28) extending laterally near the moving part (9) of the locking cylinder (7).

The various pins (13, 14, 21, 22, 25, 26, 27, 28) of the tool holder (1) are the only parts which could experience wear by friction with other parts in contact. Consequently these pins (13, 14, 21, 22, 25, 26, 27, 28) preferably undergo a surface treatment intended to increase their wear resistance and they are removable so as to be able to be replaced easily without having to completely disassemble the tool holder (1) or completely replace it.

Figure 3:
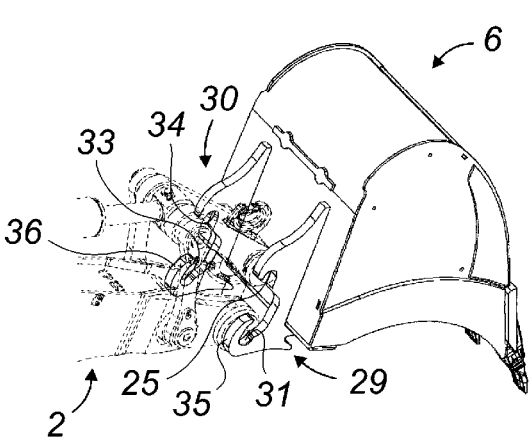
FIG. 3 is a perspective view of the working arm from FIG. 1 with an excavator bucket type tool mounted on the tool holder in which the working arm and the tool holder are faint.
Figure 4:
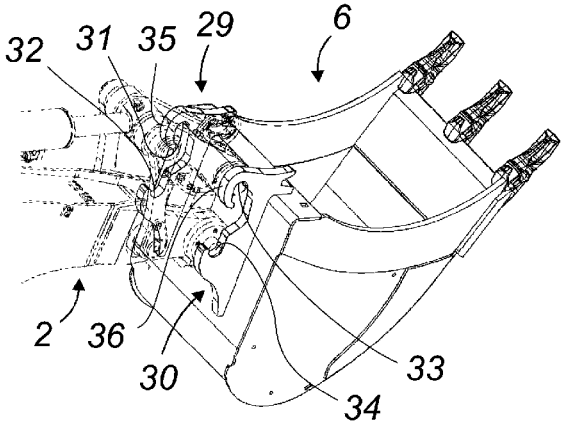
FIG. 4 is a perspective view of the working arm from FIG. 1 with a loader bucket type tool mounted on the tool holder in which the working arm and the tool holder are faint.
Figure 5:
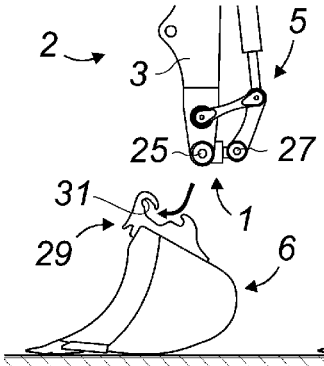
FIGS. 5 to 11 are profile views showing the sequences of gripping and locking an excavator bucket type tool by a working arm equipped with a tool holder.
Figure 6:
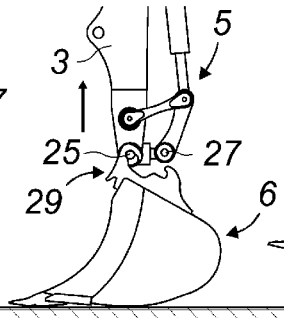
Figure 7:
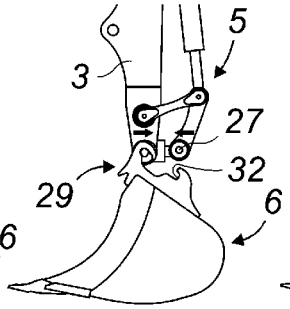
Figure 8:
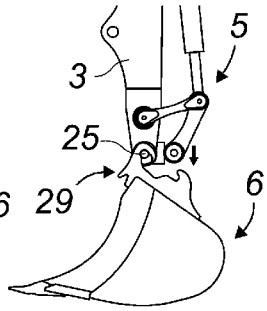
Figure 9:
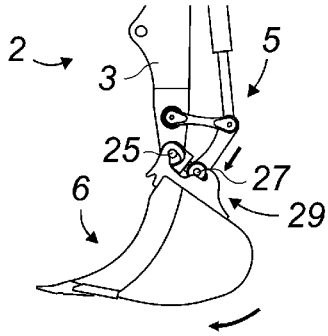
Figure 10:
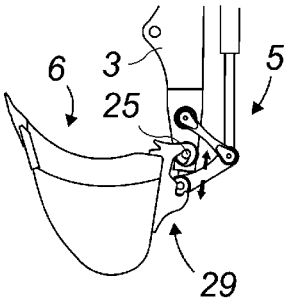

As shown in FIGS. 3 and 4, a tool (6) can be reversibly assembled with the tool holder (1), so that in that way, as an example, a bucket can be mounted in excavation position (see FIG. 3) or in loading position (see FIG. 4).

Even though, in the various figures, the tool (6) shown as an example is a bucket, it is understood that the contemplated embodiments are intended for any type of work tool such as those mentioned above.

For this purpose, the tool (6) comprises at least two receiving assemblies (29, 30) intended to engage with the gripping pins (25, 26, 27, 28) of the tool holder (1). These receiving assemblies (29, 30) can be provided on the rear surface of the tool (6), meaning on the surface thereof directed towards the tool holder (1) when it is mounted thereon. They can also be provided on the front surface of the tool (6), in particular in the case where it can be used from either side. Similarly, because the tool holder (1) is reversible, the receiving assemblies (29, 30) can be provided in either direction.

However, whatever the tool (6), these receiving assemblies (29, 30) must be provided in pairs for receiving the gripping pins (25, 26, 27, 28); one receiving assembly (29, 30) can be shared between two adjacent pairs.

Each receiving assembly (29, 30) has two receiving parts (31, 32, 33, 34) whose openings are facing and each provided for receiving one of the gripping pins (25, 26, 27, 28).

These receiving parts (31, 32, 33, 34) are preferably shaped like hooks or semicircular notch whose inner diameter is slightly greater than the outer diameter of the gripping pins (25, 26, 27, 28) that they receive.

For each receiving assembly (29, 30), the first receiving parts (31, 33) each have a gripping finger (35, 36) partially covering the opening thereof, whereas the second receiving parts (32, 34) do not have one.

Each second receiving part (32, 34) is formed by a circular notch laid-out in a plate mounted on a surface of the tool (6). The circular notch is accessible to a gripping pin (27, 28) by a movement in translation substantially parallel to the surface the tool (6). In that way, the circular notch substantially covers 50% of the perimeter of the gripping pin (27, 28).

Each gripping finger (35, 36) is also formed by a circular notch laid-out in a plate mounted on a surface of the tool (6). Additionally, an end part of the plate forming the notch covers the opening of the notch. The circular notch is accessible to a gripping pin (25, 26) by a movement in translation tending to move away from the surface the tool (6). The gripping finger (35, 36) thus covers more than 50% of the perimeter of the gripping pin (25, 26) by means of the end part covering the opening.

Preferably, one plate has an end forming a receiving part (32, 34) and another end forming a gripping finger (35, 36).

These gripping fingers (35, 36) make gripping of a tool (6) by the tool holder (1) easier and secure, as described below.

Now with reference to FIGS. 5 to 11 as an example, we are going to describe the sequences of gripping and locking an excavator bucket type tool (6) by a working arm equipped with a tool holder (1).

While the tool (6) is on the ground (see FIG. 5), the operator moves the working arm (2) so as to bring the tool holder (1) near the receiving assemblies (29, 30) and to insert the first gripping pins (25, 26) into the first receiving parts (31, 33) under the gripping fingers (35, 36). This step does not present any specific difficulty for the operator who has an unobstructed view of the tool holder (1) and the receiving assemblies (29, 30) of the tool (6).

As can be seen in particular in FIG. 1, the retention rings (17, 18) and (23, 24) are preferably chamfered for guiding and easier picking up of the tool (6) by the gripping pins (25, 26, 27, 28) of the tool holder (1).

The operator then raises the working arm (2) (see FIG. 6) so as to lift the tool (6) near the first receiving parts (31, 33) by the first gripping pins (25, 26). That done, under the weight of the tool (6), the first gripping pins (25, 26) come to lodge in the bottom of the first receiving parts (31, 33) and the tool (6) centers itself on the tool holder (1). The tool (6) is then suspended by the first gripping pins (25, 26) while swinging around receiving assemblies (29, 30). Because of the gripping fingers (35, 36), the tool is unlikely to unhook from the first gripping pins (25, 26) even in case of large amplitude swinging movement.

The locking cylinder (7) is then retracted (see FIG. 7), so as to bring the first gripping pins (25, 26) the closest to the second gripping pins (27, 28).

The operator then actuates the link and cylinder assembly (5) of the work arm (2) (see FIG. 8) so as to insert the second gripping pins (27, 28) into the receiving assemblies (29, 30). With the cylinder in retracted position, the second gripping pins (27, 28) can then enter into the receiving assemblies (29, 30) and be positioned opposite from the second receiving parts (32, 34).

The operator next continues the movement of the link and cylinder assembly (5) of the working arm (2) (see FIG. 9) so as to bring the second gripping pins (27, 28) to a stop in the bottom of the receiving assemblies (29, 30) and to exert a thrust there which causes the tool (6) to swing around the first gripping pins (25, 26).

When the operator observes the swing of the tool (6), they know that it is firmly held on the tool holder (1) and that the operator can consequently lock it.

To do that, the locking cylinder (7) is then extended (see FIG. 10), so as to separate the first gripping pins (25, 26) from the second gripping pins (27, 28). These gripping pins (25, 26, 27, 28) are then positioned engaged in the bottom of each receiving part (31, 33, 34, 35) associated therewith, which secures the tool (6) in position.

Figure 11:
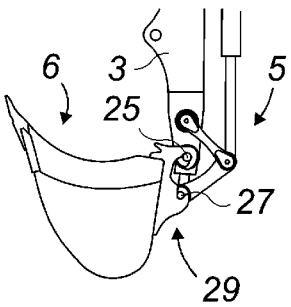
Figure 12:
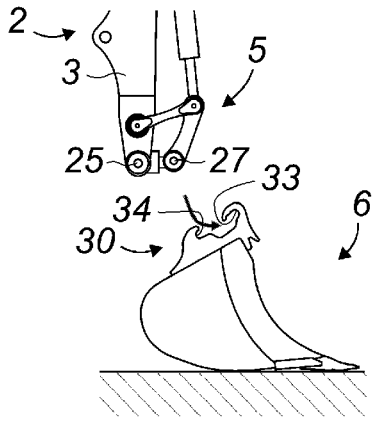
FIGS. 12 to 17 are profile views showing the sequences of gripping and locking a backward bucket type tool taken as loader by a working arm equipped with a tool holder.
Figure 13:
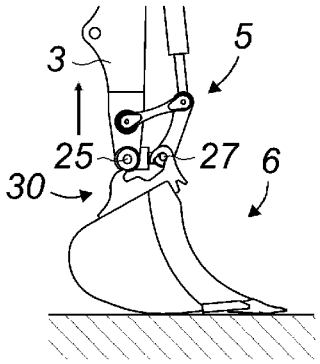

By securing the locking cylinder (7) in this position, the tool (6) is then locked on the tool holder (1) and can be used conventionally (see FIG. 11).

Now with reference to FIGS. 12 to 17 as an example, the sequences of gripping and locking a reversed bucket used as loader type tool (6) by a working arm equipped with a tool holder (1) can be understood.

While the tool (6) is on the ground (see FIG. 12), it is the second gripping pins (27, 28) which are inserted into the first receiving parts (31, 33) under the gripping fingers (35, 36).

Figure 14:
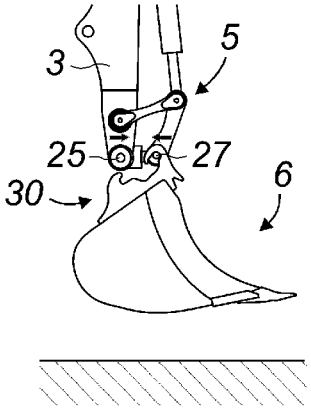

The operator then raises the working arm (2) (see FIG. 13), and then the locking cylinder (7) is retracted (see FIG. 14).

Figure 15:
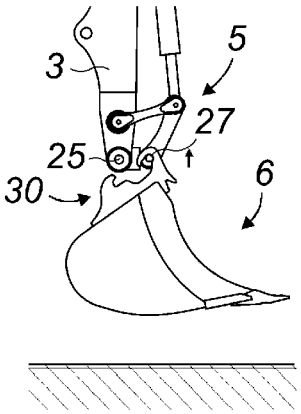
Figure 16:
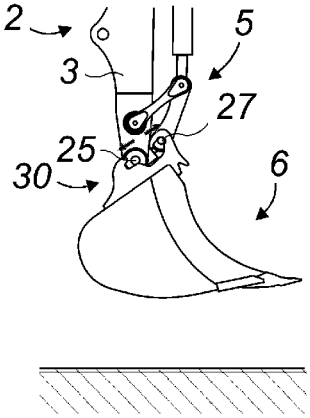

The first gripping pins (25, 26) are inserted into the receiving assemblies (29, 30) and are located opposite the second receiving parts (32, 34) (see FIG. 15). The operator next continues the movement of the link and cylinder assembly (5) until the tool (6) swings around the second gripping pins (27, 28).

The operator then actuates the locking cylinder (7) into extended position (see FIG. 16) for securing the tool (6) in position.

Figure 17:
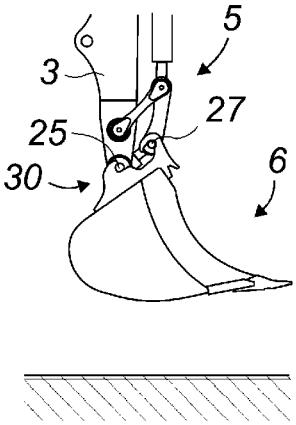

The tool (6) is then locked on the tool holder (1) and can be used conventionally (see FIG. 17).

It will be noted that the sequences described above are substantially similar. For obvious reasons of safety, whatever the tool (6) to be mounted on the working arm (2), one always starts by inserting the suitable gripping pins into the first receiving parts (31, 33) under the gripping fingers (35, 36). Because of the reversibility thereof, the tool holder (1) can advantageously hold and lock a tool (6) in both directions.

Figure 18:
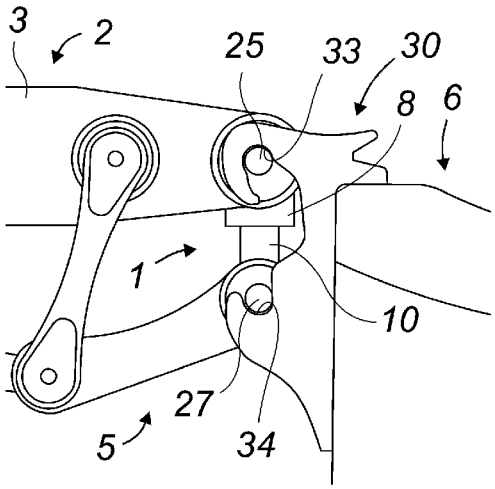
FIG. 18 is a detailed profile view of the tool holder in locked position of a tool.
Figure 19:
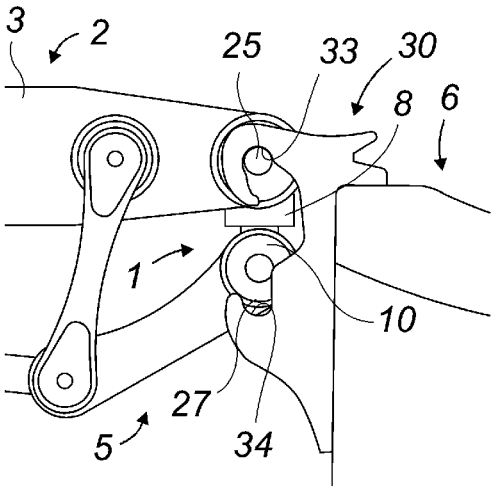
FIG. 19 is a detailed profile view of the tool holder in unlocked position of a tool.

The principle of locking the tool (6) by the tool holder (1) is shown in FIGS. 18 and 19.

In FIG. 18, the cylinder is in an extended position and the gripping pins (25, 26, 27, 28) are wedged stop against the bottom of each receiving part (31, 33, 34, 35) associated therewith. The tool (6) is retained and cannot disengage. In case of failure of the locking cylinder (7), or if it is forced so as to extract the gripping pins (25, 26, 27, 28) out of their receiving part (31, 33, 34, 35), only the gripping pins (25, 26, 27, 28) located in the second receiving parts (32, 34) could be extracted from the receiving assemblies (29, 30) whereas the other gripping pins (25, 26, 27, 28) will still be held in the first receiving parts (31, 33) because of the presence of the gripping fingers (35, 36). The partially unlocked tool then swings around these gripping pins (25, 26, 27, 28) but does not fully unhook from the tool holder (1) and cannot fall, which is particularly good for promoting safety.

In order to avoid the gripping pins (25, 26, 27, 28) from accidentally coming closer, the locking cylinder (7) is preferably equipped with an anti-return valve which secures the fluid in the large chamber when the locking cylinder (7) is subject to external forces, for example resulting from digging. This anti-return valve is preferably placed in the rod (10) closest to the chamber to be protected, in order to overcome possible leaks between the chamber and the valve if the latter were to be turned aside and connected to the chamber by hoses or similar.

According to a preferred embodiment, the extended locking position of the locking cylinder (7) does not correspond to the end of range thereof, such that the same locking cylinder (7) for the tool holder (1) can continue to be used in case of play arising for example from a problem of wear or deformation of the parts. In that way, if the extended locking position of the locking cylinder (7) requires a range greater than that previously needed for locking, a larger range is available for the locking cylinder (7). According to this embodiment, because of the extra range that it has, the locking cylinder (7) then includes a means for detection of the position of the rod (10) so as to provide good locking of the tool (6) by the tool holder (1).

It is evident that this description is not limited to the examples explicitly described, but that it also includes other embodiments and/or implementations. Thus, a technical feature described may be replaced by an equivalent technical feature without going outside the scope of the present disclosure and a described step of the implementation of the method may be replaced by an equivalent step without going outside the scope of the disclosure.

Figure 20:
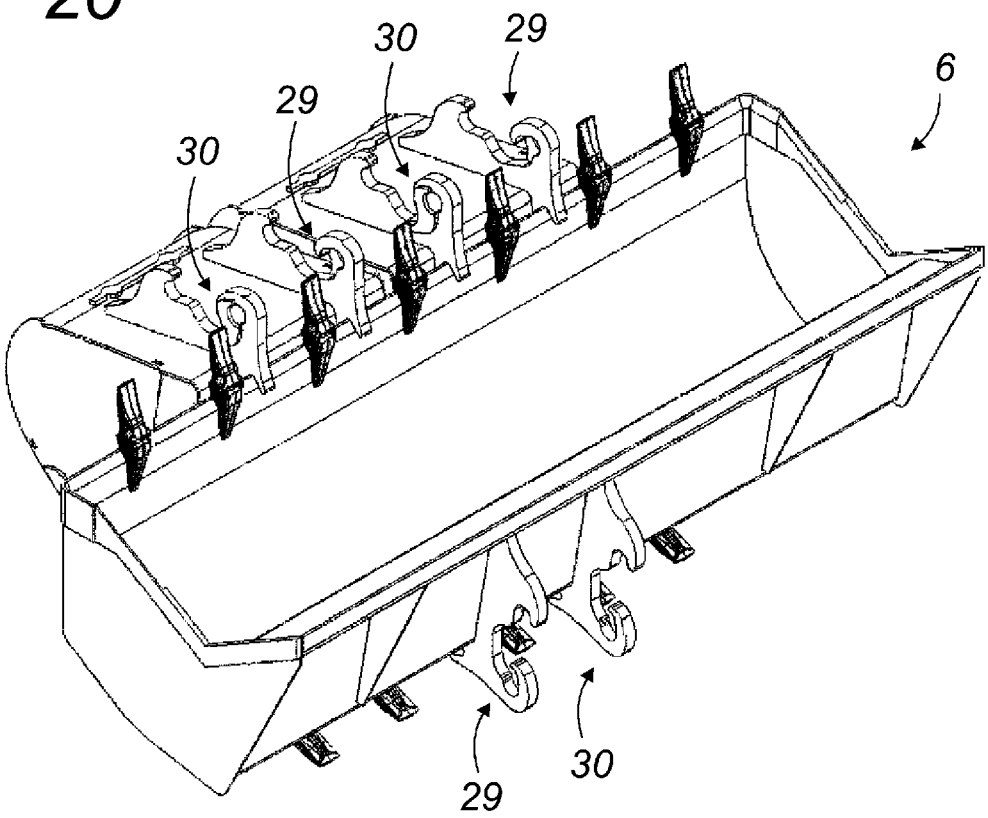
FIG. 20 is a perspective view of a transport bucket for a loader comprising several plugs adapted in such a way as to allow a tool holder to grasp it.

In that way, the disclosed and contemplated embodiments can be adapted to any type of tool, and the tools can comprise several receiving assemblies (29, 30) provided in pairs, for example on the front and rear surfaces thereof in order to be able to freely mount them on the tool holder (1) in either direction. As an example, a transport bucket with which to transport several tools with the one mounted on the machine for trips on the worksite is shown in FIG. 20 comprising several receiving assemblies (29, 30) provided in pairs.

The invention claimed is:

1. An assembly formed by a tool and a tool holder intended to allow the quick and reversible assembly of a tool on the free end of the working arm of the worksite or construction machine, where the working arm comprises a stick that ends in a fork and is equipped with a link and cylinder assembly intended to manipulate the tool when it is mounted on the free end thereof, wherein:

the tool holder comprises a locking cylinder comprising a fixed part rotatably mounted on the free end of the stick and a moving part connected to the fixed part by a rod and mounted pivoting on the end of the link and cylinder assembly;

the tool holder comprises two first gripping pins extending laterally from each side of the fixed part and two second gripping pins extending laterally from each side of the moving part of the locking cylinder;

the tool comprises at least two receiving assemblies suited to engage with the gripping pins of the tool holder;

each receiving assembly comprises a corresponding gripping finger forming a first receiving part, and a second receiving part, for which the openings are facing and each intended to receive one of the first gripping pins and one of the second gripping pins in order to keep the tool on the tool holder;

the tool is suited to be locked and unlocked on the tool holder by means of the locking cylinder by reversibly changing the distance between the moving part and the fixed part thereof, between an extended position of the locking cylinder in which each of the first gripping pins is moved into abutment at the bottom of the associated receiving portion thereof and each of the second gripping pins is moved into abutment at the bottom of the associated receiving portion thereof, and a retracted position of the locking cylinder in which the gripping pins are configured to be extracted from the receiving assemblies;

wherein each of the gripping fingers comprises a circular notch and a hooked end-part extending away from the corresponding gripping pin when the gripping pin is seated in the circular notch, such that the circular notch and the hooked end-part cooperate to cover more than 50% of the perimeter of the gripping pin and such that the tool does not unhook from the first gripping pins in case of large amplitude swinging movement;

wherein each receiving assembly comprises a single plate, and wherein, for each receiving assembly, the centers of the circular notches of the first and second receiving parts, considered together, are substantially parallel to a base of the receiving assembly.

2. An assembly formed of a tool and a tool holder according to claim 1, wherein the receiving parts are shaped like hooks or semicircular notch whose inner diameter is slightly greater than the outer diameter of the gripping pins that they receive.

3. An assembly formed of a tool and a tool holder according to claim 1, wherein the first receiving parts each have a gripping finger partially covering the opening thereof, whereas the second receiving parts do not.

4. An assembly formed of a tool and a tool holder according to claim 1, wherein the fixed part of the locking cylinder comprises a mounting pin on each of the lateral sides thereof which is held on the fork by a chamfered retaining ring.

5. An assembly formed of a tool and a tool holder according to claim 1, wherein the moving part of the locking cylinder comprises a mounting pin on each of the lateral sides thereof which is held near the end of the link and cylinder assembly by a chamfered retaining ring.

6. An assembly formed of a tool and a tool holder according to claim 1, wherein, the locking cylinder is equipped with an anti-return valve which secures the fluid in the large chamber when the locking cylinder is subject to external forces.

7. An assembly formed of a tool and a tool holder according to claim 6, wherein, the anti-return valve is placed in the rod closest to the chamber to be protected.

8. An assembly formed of a tool and a tool holder according to claim 1, wherein the locking cylinder has an intended over-range such that the locking extended position of the locking cylinder does not correspond to the end of range thereof.

9. An assembly formed of a tool and a tool holder according to claim 1, wherein the locking cylinder is equipped with a position detector configured to detect the position of the rod so as to provide good locking of the tool by the tool holder.

10. An assembly formed of a tool and a tool holder according to claim 1, wherein the receiving parts and the gripping pins have the same diameter.

* * * * *